US007633453B2

(12) United States Patent
Kono et al.

(10) Patent No.: US 7,633,453 B2
(45) Date of Patent: Dec. 15, 2009

(54) ON-VEHICLE FILM ANTENNA

(75) Inventors: Syuichi Kono, Okazaki (JP); Yuji Sugimoto, Kariya (JP); Toshihiro Hattori, Okazaki (JP); Toru Yamazaki, Chita (JP); Koji Numata, Toyokawa (JP); Masaaki Hisada, Obu (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 568 days.

(21) Appl. No.: 11/475,536

(22) Filed: Jun. 27, 2006

(65) Prior Publication Data

US 2007/0001915 A1 Jan. 4, 2007

(30) Foreign Application Priority Data

Jul. 4, 2005 (JP) ..... 2005-194931

(51) Int. Cl.
*H01Q 1/32* (2006.01)

(52) U.S. Cl. ..... 343/713; 343/728

(58) Field of Classification Search ..... 343/711, 343/712, 713, 725, 728
See application file for complete search history.

(56) References Cited

U.S. PATENT DOCUMENTS 6,535,170 B2 3/2003 Sawamura et al.
6,891,515 B1 * 5/2005 Langley et al. ..... 343/895
7,030,821 B2 * 4/2006 Mathiae et al. ..... 343/711
2005/0264461 A1 * 12/2005 Sugimoto et al. ..... 343/713
2007/0097001 A1 * 5/2007 Sugimoto et al. ..... 343/713

FOREIGN PATENT DOCUMENTS

JP 2001-102836 4/2001
JP 2002-135025 5/2002
JP 2002-185238 6/2002
JP 2004-072419 3/2004
JP 2005-167619 6/2005

OTHER PUBLICATIONS

Office action dated Dec. 9, 2008 in Japanese application No. 2005-194931.
Office action dated Jun. 2, 2009 in corresponding Japanese application No. 2005-194931.

* cited by examiner

*Primary Examiner*—Tan Ho
(74) *Attorney, Agent, or Firm*—Harness, Dickey & Pierce, PLC

(57) ABSTRACT

An on-vehicle film antenna is constructed with a loop antenna and a monopole antenna and attached to a vehicle windshield. The loop antenna has a first element set in length to correspond to a first radio wave of a first frequency band. One end of the first element is connected to a power supply near a border section between a vehicle chassis and the vehicle windshield, and the other end of the first element is connected to the vehicle chassis. The monopole antenna has a second element set in length to correspond to a second radio wave of a second frequency band. One end of the second element is connected to the power supply near the border section in common with the one end of the first element, and the other end of the second element is disconnected from the vehicle chassis.

4 Claims, 5 Drawing Sheets

ON-VEHICLE FILM ANTENNA

CROSS REFERENCE TO RELATED APPLICATION

This application is based on and incorporates herein by reference Japanese Patent Application No. 2005-194931 filed on Jul. 4, 2005.

FIELD OF THE INVENTION

The present invention relates to an on-vehicle film antenna attached to a vehicle windshield.

BACKGROUND OF THE INVENTION

As a vehicle-mounted antenna, a rod antenna, a film antenna or the like is proposed. A film antenna, which is attached to a vehicle windshield (window), is most often adopted recently, because it is not deformed by impact, does not generate whipping sounds, does not damage outlook. One example of such a film antenna is disclosed in JP 2004-72419A.

An improved film antenna is also proposed in US 2005/0264461 A1. This antenna is a loop type for receiving radio waves of UHF band (470 MHz to 770 MHz) corresponding to digital television broadcasting. It is preferred that this antenna is adapted to be capable of also receiving radio waves of VHF band (90 MHz to 220 MHz) corresponding to digital radio broadcasting in addition to the radio waves of the UHF band.

If a loop antenna is adapted to receive the radio waves of the VHF band, the antenna needs to have an antenna element length, which is about one half of the wavelength of the radio wave of the VHF band. As a result, the loop antenna becomes large in its entire size and hinders visibility through a vehicle windshield. If a loop antenna for receiving radio waves of the UHF band and a loop antenna for receiving radio waves of the VHF band are constructed separately, the two loop antennas must be attached to a vehicle windshield. As a result, assembling work becomes complicated, and adds costs due to necessity of power supply terminals and electric wirings for the two antennas.

SUMMARY OF THE INVENTION

The present invention therefore has an object to provide an on-vehicle film antenna, which receives both radio waves in two different frequency bands without hindering visibility through a vehicle windshield.

In one aspect, an on-vehicle film antenna is constructed with a loop antenna and a monopole antenna and attached to a vehicle windshield. The loop antenna has a first element set in length to correspond to a first radio wave of a first frequency band. One end of the first element is connected to a power supply near a border section between a vehicle chassis and the vehicle windshield, and another end of the first element is connected to the vehicle chassis. The monopole antenna has a second element set in length to correspond to a second radio wave of a second frequency band. One end of the second element is connected to the power supply near the border section in common with the one end of the first element, and another end of the second element is disconnected from the vehicle chassis.

In another aspect, an on-vehicle film antenna is constructed with a switchable antenna and attached to a vehicle windshield. The switchable antenna has an element, which is switchably coupled capacitively to the vehicle chassis. One end of the element is connected to a power supply near a border section between a vehicle chassis and the vehicle windshield, and another end of the element is connectable to the vehicle chassis to receive a radio wave of a first frequency band and disconnectable from the vehicle chassis to receive a radio wave of a second frequency band.

In a further aspect, an on-vehicle film antenna is constructed with a switchable antenna and a switch and attached to a vehicle windshield. The switchable antenna has an element, which is switchably connectable to the vehicle chassis. One end of the element is connected to a power supply near a border section between a vehicle chassis and the vehicle windshield, and another end of the element is connectable to the vehicle chassis. The switch is connected between the another end and the vehicle chassis to selectively connect and disconnect the element to and from the vehicle chassis.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EMBODIMENT

First Embodiment

Figure 1:
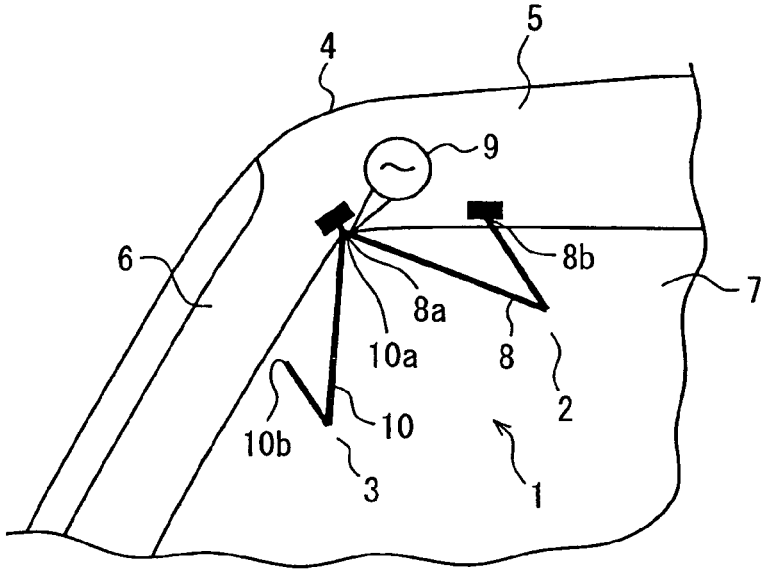
FIG. 1 is a schematic view showing an on-vehicle antenna according to a first embodiment of the present invention.

Referring first to FIG. 1, an on-vehicle antenna 1 is constructed with a loop antenna 2 and a monopole antenna 3. Those antennas 2 and 3 are integrated and attached to a front windshield 7 of a vehicle near a corner section at which a ceiling part 5 and a front pillar part 6 of a vehicle chassis 4 join. Here, the corner section includes an area of the ceiling part 5 near the corner section and an area of the pillar part 6 near the corner section.

The loop antenna 2 has an element 8, which is bent to have an acute angle. One end 8*a* of the element 8 is connected to a power supply 9 near the corner section of the ceiling part 5 and the pillar part 6 and near the boundary with the front windshield 7. The other end 8*b* of the element 8 is connected to the ceiling part 5 of the vehicle chassis 4, which is a grounding plate. Thus, the element 8 is formed in a triangular loop. The length of the element 8, that is, length between the ends 8*a* and 8*b*, is set to about one half of the wavelength of the radio wave of the UHF band (470 MHz to 770 MHz), which is a frequency band of a digital television broadcasting.

The length of the element 8 may be set in consideration of the wavelength reduction ratio, which is about 0.7 to 0.8 times, due to the dielectric constant of a glass of the front windshield 7. The angle of bending of the element 8 is acute so that a capacitive coupling is provided between two straight pieces of the element 8. The angle of grounding of the element 8 relative to the vehicle chassis 4 is also acute so that a capacitive coupling is provided between the element 8 and the vehicle chassis 4. Thus, the radio wave of the UHF band, which can be received, is widened in frequency.

The monopole antenna 3 has an element 10, which is bent to have an acute angle. One end 10*a* of the element 10 is connected to the power supply 9 near the corner section of the ceiling part 5 and the pillar part 6 and near the boundary with the front windshield 7. The other end 10*b* of the element 10 is disconnected from the vehicle chassis 4. The length of the element 10, that is, length between the ends 10*a* and 10*b*, is set to about one quarter of the wavelength of the radio wave of the VHF band (90 MHz to 220 MHz), which is a frequency band of a digital radio broadcasting.

The length of the element 10 may be set in consideration of the wavelength reduction ratio, which is about 0.7 to 0.8 times, due to the dielectric constant of the glass of the front windshield 7. The angle of bending of the element 10 is acute so that a capacitive coupling is provided between two straight pieces of the element 10. Thus, the radio wave of the VHF band, which can be received, is widened in frequency. Since both the loop antenna 2 and the monopole antenna 3 are connected in common to the power supply 9, the radio wave of the UHF band and the radio wave of the VHF band need be separated by a tuner (not shown).

Figure 2:
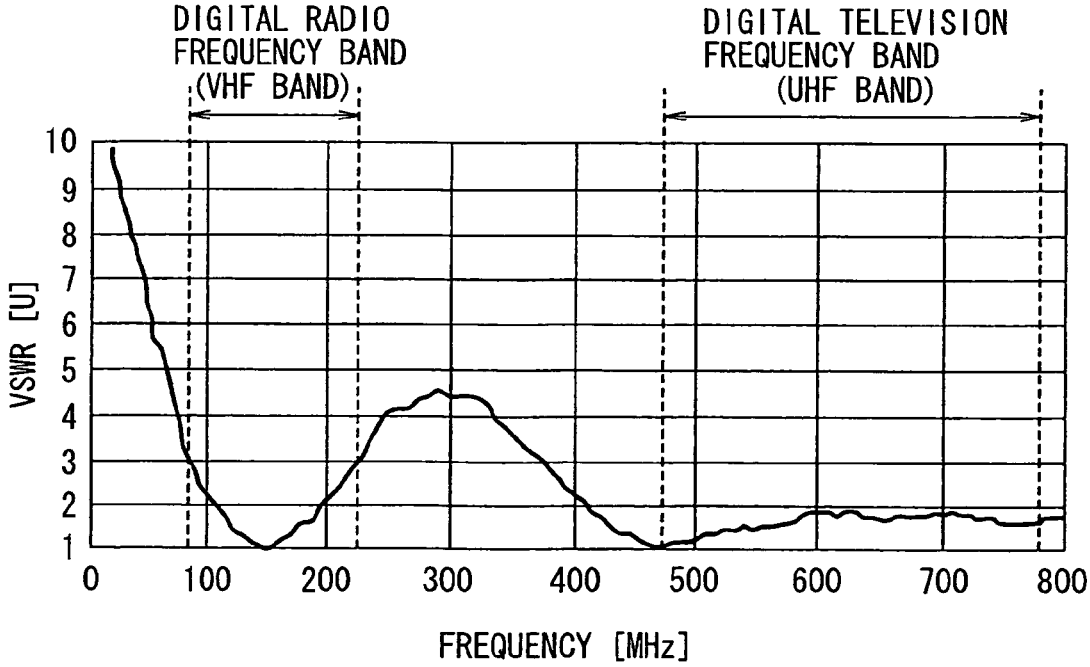
FIG. 2 is a characteristic graph showing a measurement of VSWR in the UHF band and the VHF band.

As understood from FIG. 2 showing the measured result of a voltage surface wave ratio (VSWR) of the on-vehicle antenna 1, the loop antenna 2 has a low value in the UHF band and the monopole antenna 3 has a low value in the VHF band.

According to the first embodiment, the antenna for receiving the radio wave of the UHF band is constructed by the loop antenna 2 having the element length which is one half of the wavelength of the radio wave of the UHF band, and the antenna for receiving the radio wave of the VHF band is constructed by the monopole antenna 3 having the element length which is one quarter of the radio wave of the VHF band. As a result, the size of the entire antenna can be made small not to hinder the visibility, while ensuring reception of both the radio waves of the UHF band and the VHF band.

Since the loop antenna 2 and the monopole antenna 3 are integrated into a single unit, both antennas can be attached to the front windshield 7 at the same time thus simplifying attachment work. Further, since the loop antenna 2 and the monopole antenna 3 are connected in common to the power supply 9, power supply to the antennas can be attained by only one electric wiring thus reducing cost.

The on-vehicle antenna 1 is provided near the corner section at which the ceiling part 6 and the pillar part 6 join. As a result, radio waves arriving from the vehicle front part can be surely received. Further, even if radio waves arrive from the vehicle rear part, diffracted waves thereof arriving from the vehicle side surface and the ceiling surface of the vehicle chassis 4 can be more efficiently received. That is, the antenna 1 can stably receive the radio waves irrespective of directions in which the vehicle is heading and the radio waves are arriving.

The first embodiment may be modified in various manners.

Figure 3:
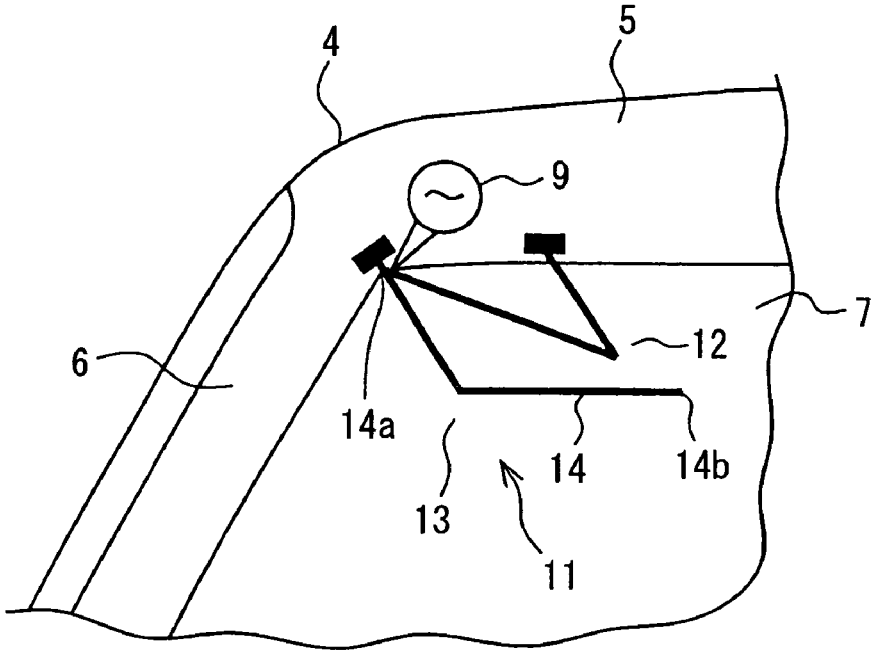
FIG. 3 is a schematic view showing a first modification of the first embodiment.

As a first modification, as shown in FIG. 3, an on-vehicle antenna 11 is constructed with a loop antenna 12 and a monopole antenna 13, which are integrated to each other. The loop antenna 12 is formed in the same shape as the loop antenna 2 shown in FIG. 1. One end 14*a* of an antenna element 14 of the monopole antenna 13 is connected to the power supply 9 at the corner section at which the ceiling part 5 and the pillar part 6 join and which is a boundary section with the front windshield 7. The other end 14*b* of the element 14 is disconnected from the vehicle chassis 4.

The element 14 is shaped to extend from the corner section between the ceiling part 5 and the pillar part 6 towards the radially inside part of the windshield frame, so that the other end 14*b* is distanced away from the corner section towards the lateral downward point on the front windshield 7. As a result, the polarized surface is inclined and hence the antenna can have a non-directional characteristic. The monopole antenna 13 is bent towards and closely to the loop antenna 12. Therefore, the antenna 11 can be arranged in a small area.

Figure 4:
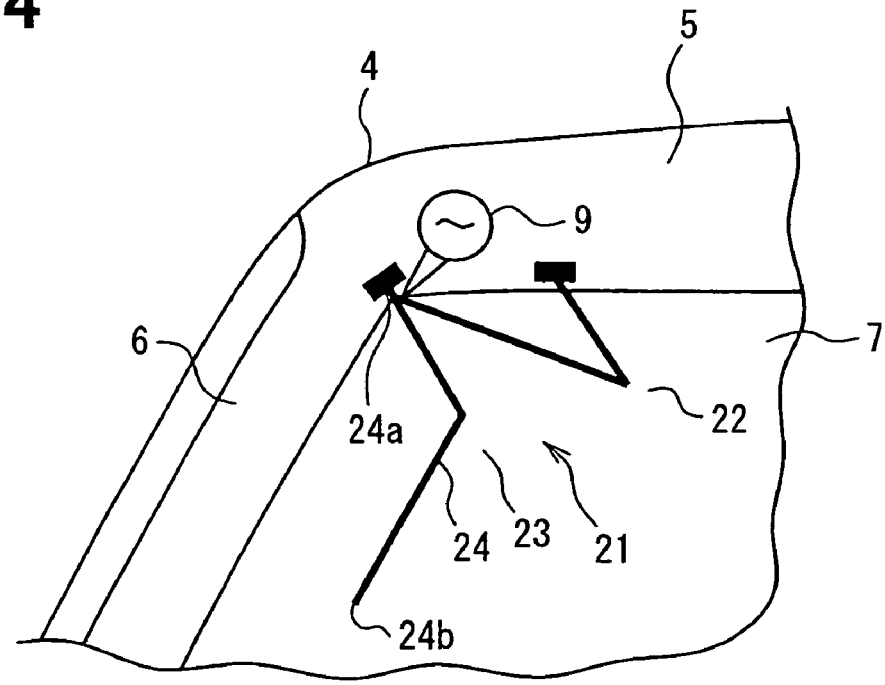
FIG. 4 is a schematic view showing a second modification of the first embodiment.

As a second modification, as shown in FIG. 4, an on-vehicle antenna 21 is constructed with a loop antenna 22 and a monopole antenna 23, which are integrated to each other. The loop antenna 22 is formed in the same shape as the loop antenna 2 shown in FIG. 1. One end 24*a* of an antenna element 24 of the monopole antenna 23 is connected to the power supply 9 at the corner section at which the ceiling part 5 and the pillar part 6 join and which is a boundary section with the front windshield 7. The other end 24*b* of the element 24 is disconnected from the vehicle chassis 4. The element 24 is shaped to extend from the corner section between the ceiling part 5 and the pillar part 6, so that the other end 24*b* is distanced towards the downward point on the front windshield 7. As a result, the polarized surface is inclined and hence the antenna can have a non-directional characteristic.

Figure 5:
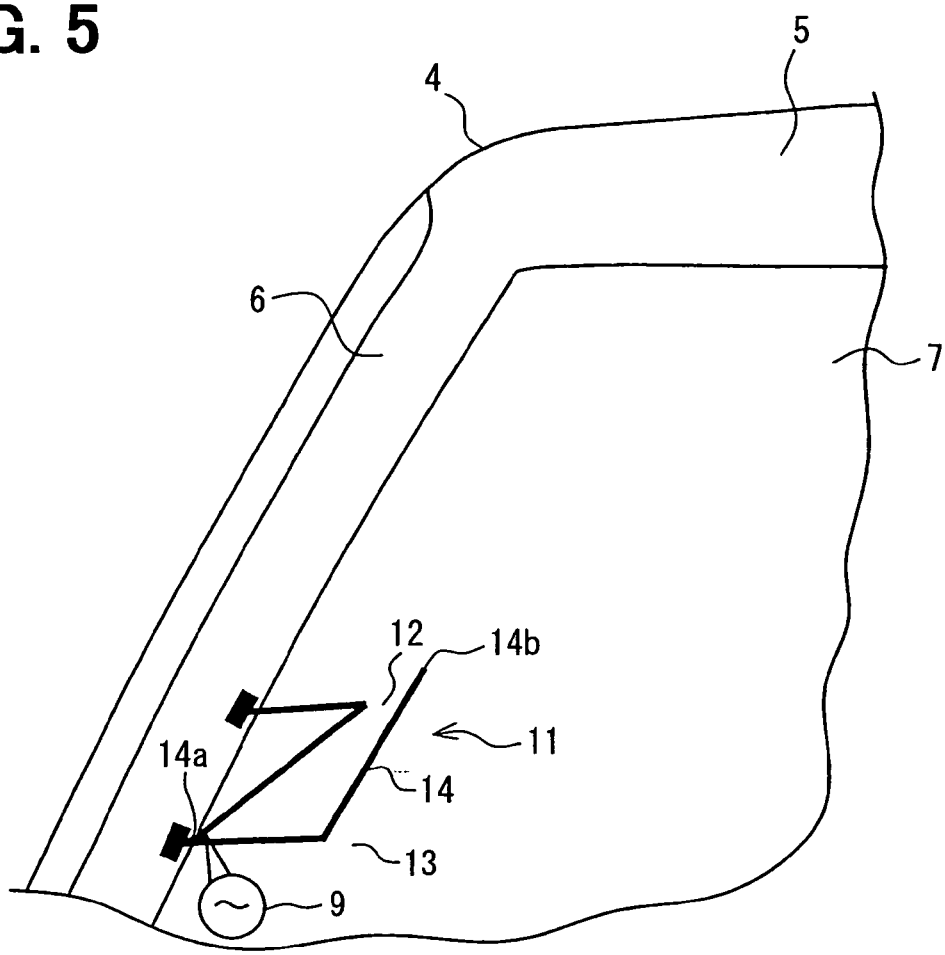
FIG. 5 is a schematic view showing a third modification of the first embodiment.

As a third modification, as shown in FIG. 5, the on-vehicle antenna 11 is provided near the lower part of the pillar part 6.

Figure 6:
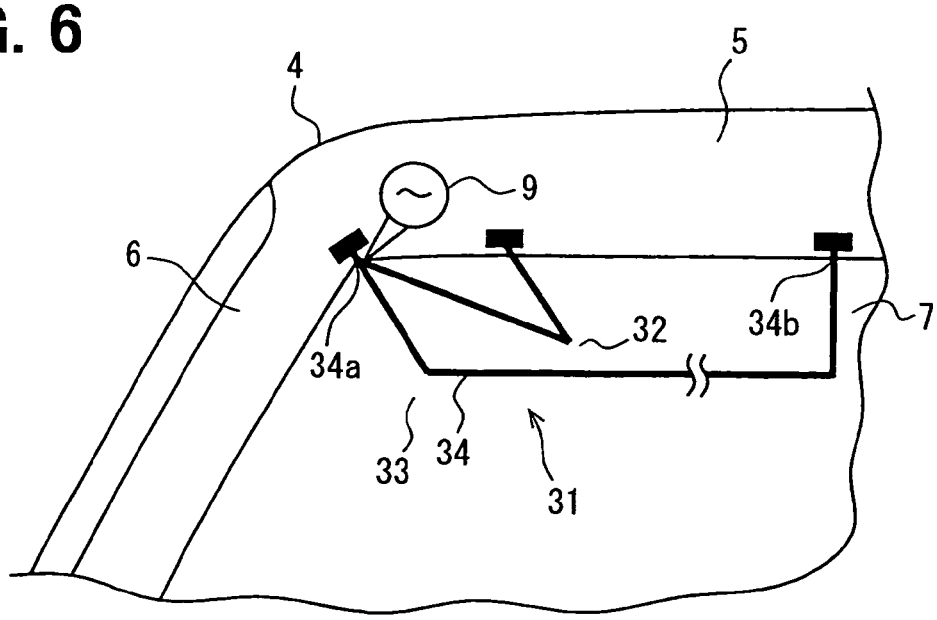
FIG. 6 is a schematic view showing a fourth modification of the first embodiment.

As a fourth modification, as shown in FIG. 6, an on-vehicle antenna 31 is constructed with two loop antennas 32 and 33 integrated to each other. Thus, the antenna 33 for receiving the radio wave of the VHF band is also connected to the ceiling part 5 of vehicle chassis 4. The antenna 33 is formed by bending an antenna element 34.

One end 34*a* of the element 34 is connected to the power supply 9 near the corner section of the ceiling part 5 and the pillar part 6 and near the boundary with the front windshield 7. The other end 34*b* of the element 34 is connected to the ceiling part 5 of the vehicle chassis 4, which is a grounding plate. The length of the element 34, that is, length between the ends 34*a* and 34*b*, is set to about one half of the wavelength of the radio wave of the VHF band. The length of the element 34 may be set in consideration of the wavelength reduction ratio, which is about 0.7 to 0.8 times, due to the dielectric constant of a glass of the front windshield 7. The antenna 32 is also connected to the power supply 9.

Figure 7:
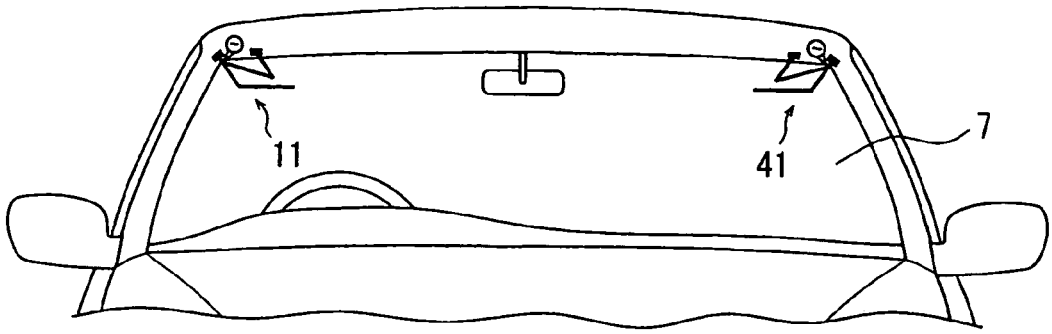
FIG. 7 is a schematic view showing two on-vehicle antennas attached to a front windshield for diversity reception.

According to an arrangement shown in FIG. 7, the on-vehicle antenna 11 shown in FIG. 3 is attached to the left uppermost corner section of the front windshield 7, when viewed from the front end of the vehicle. Another on-vehicle antenna 41, which is similar in construction to the antenna 11, is attached to the right uppermost corner section of the front windshield 7 in the generally symmetrical manner to the antenna 11. By thus arranging the antennas 11 and 41 in the left and right uppermost corner sections in symmetrical relation to each other, space diversity can be realized.

Figure 8:
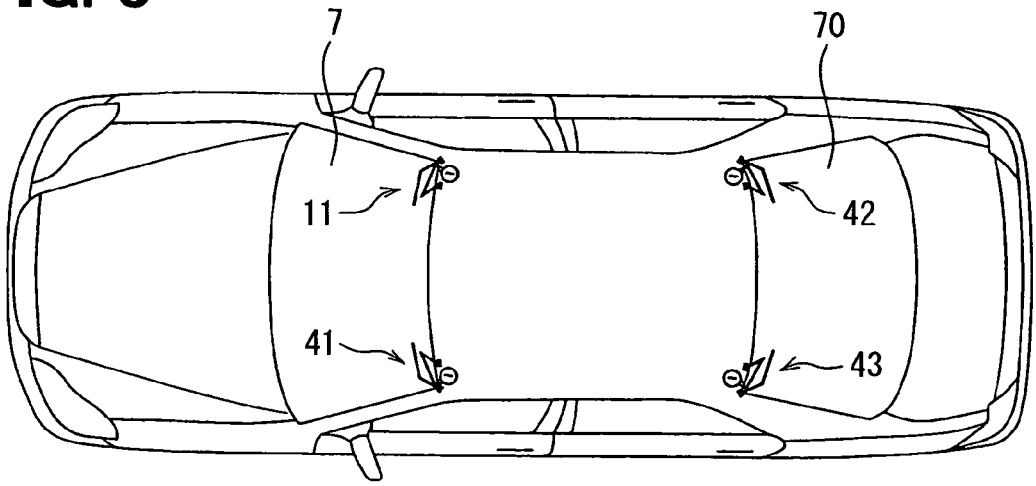
FIG. 8 is a schematic view showing two on-vehicle antennas attached to a rear windshield for diversity reception in addition to the arrangement shown in FIG. 7.

According to an arrangement shown in FIG. 8, two on-vehicle antennas 42 and 43 are attached to a rear windshield 70 in addition to the antennas 11 and 41 shown in FIG. 7. The antennas 42 and 43 are similar in construction to the antennas 11 and 41 and attached to the right and left uppermost corner sections of the rear windshield 70, when viewed from the rear end of the vehicle. The antennas 42 and 43 are arranged generally symmetrically to each other in the lateral direction as the antennas 11 and 41 are. In addition, the antennas 42 and 43 are arranged generally symmetrically with the antennas 11 and 43 in the longitudinal direction of the vehicle, respectively. This symmetrical arrangement in both the lateral direction and the longitudinal direction further enhances the space diversity.

Second Embodiment

Figure 9:
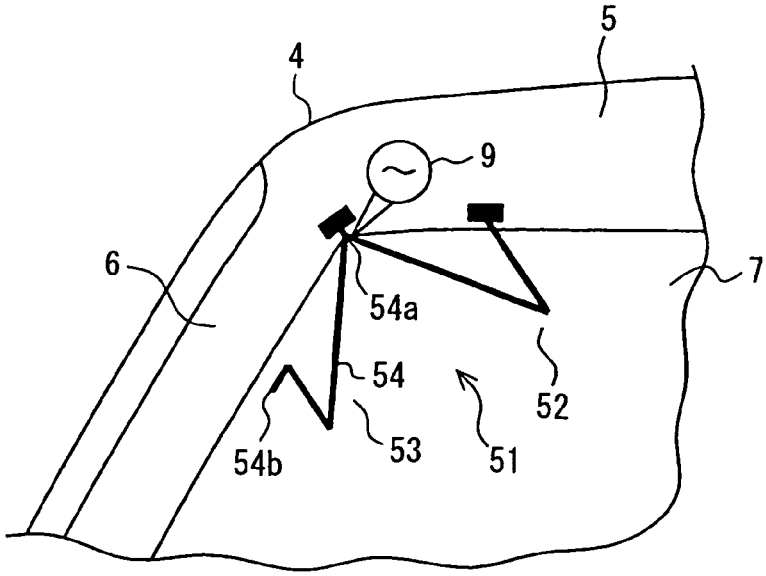
FIG. 9 is a schematic view showing an on-vehicle antenna according to a second embodiment of the present invention.

In a second embodiment shown in FIG. 9, an on-vehicle antenna 51 is constructed with a loop antenna 52 and a switchable antenna 53, which are integrated with each other. The loop antenna 52 is shaped and arranged in generally the same manner as the loop antenna 2 shown in FIG. 2. The switchable antenna 53 is shaped in generally the similar manner as the monopole antenna 3.

One end 54*a* of an antenna element 54 of the switchable antenna 53 is connected to the power supply 9 in common with the loop antenna 52 at the corner section at which the ceiling part 5 and the pillar part 6 join. However, the other end 54*b* of the element 54 is switchably arranged, so that the element 54 may be connected or shorted to the vehicle chassis 4 for receiving the radio wave of the UHF band but disconnected from the vehicle chassis 4 for receiving the radio wave of the VHF band. Thus the capacitive coupling of the element 54 to the vehicle chassis 4 is made switchable.

According to the second embodiment, since the antenna 53 is switchable to a loop antenna (the end 54*b* is grounded to the chassis 4 for receiving the UHF band radio wave) and to a monopole antenna (the end 54*b* is made open from the chassis 4 for receiving the VHF band radio wave), the on-vehicle antenna 51 can receive both radio waves in the UHF band and the VHF band.

Since the antenna 53 is switchable, it operates as the loop antenna and the monopole antenna, the operation characteristics of which are different. When the antenna 53 is switched to operate as the loop antenna for the UHF band, two loop surfaces are formed jointly with the loop antenna 52 thus increasing an antenna gain based on antenna arrangement effect. Further, non-directional characteristic is furthermore enhanced.

Figure 10:
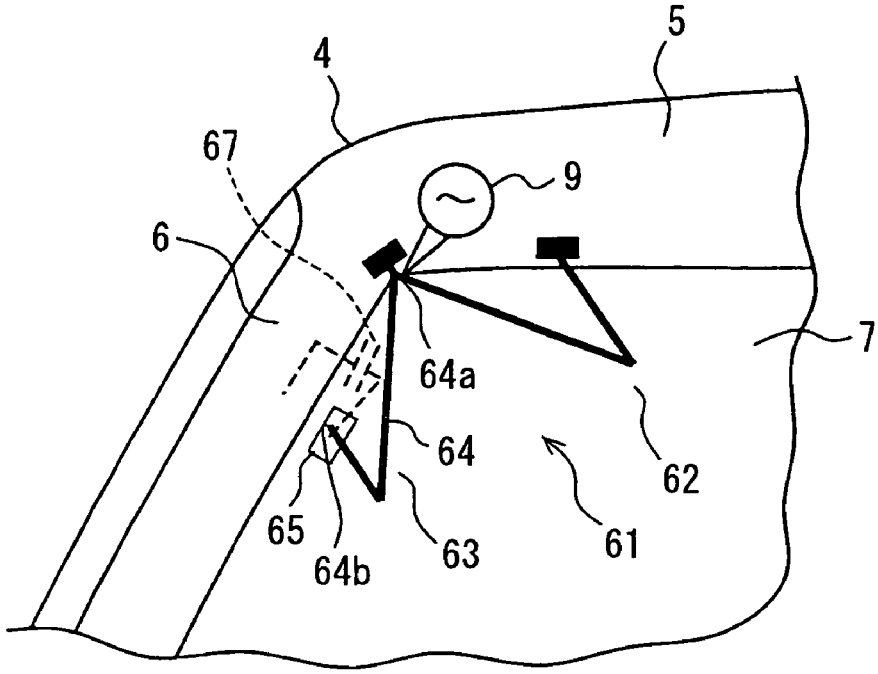
FIG. 10 is a schematic view showing an on-vehicle antenna according to a modification of the second embodiment.

As a modification of the second embodiment, as shown in FIG. 10, an on-vehicle antenna 61 is constructed with a loop antenna 62 and a switchable antenna 63 in generally the similar shape as the on-vehicle antenna 51. The antennas 62 and 63 are integrated with each other. One end 64*a* of an element 64 is connected to the power supply 9 in common to the loop antenna 62, but the other end 64*b* is attached to a conductive tape 65. In this modification, the element 64 can be surely coupled capacitively to the vehicle chassis 4 by attaching the conductive tape 65 to the vehicle chassis 4 for receiving the UHF band radio wave. A capacitor element 67 may be used in place of the conductive tape 65 as shown by a dotted line in FIG. 10.

Third Embodiment

Figure 11:
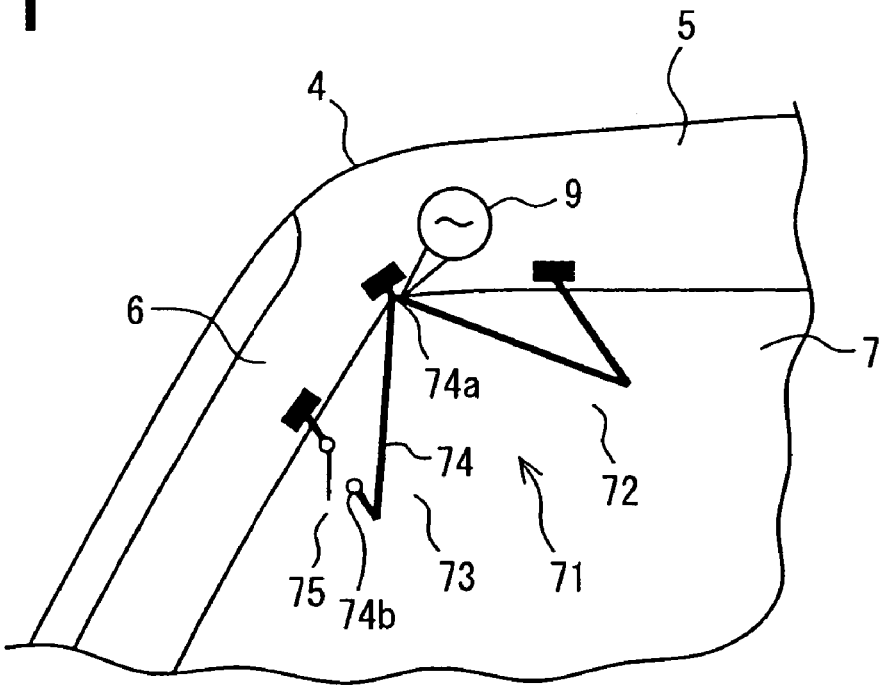
FIG. 11 is a schematic view showing an on-vehicle antenna according to a third embodiment of the present invention.

In a third embodiment shown in FIG. 11, an on-vehicle antenna 71 is constructed with a loop antenna 72 and a switchable antenna 73, which are integrated to each other. The loop antenna 72 is constructed and arranged in generally the same manner as the loop antenna 2 shown in FIG. 1. The switchable antenna 73 has an antenna element 74 in the generally similar manner as the monopole antenna 3 shown in FIG. 1.

One end 74*a* of the element 74 is connected to the power supply 9 in common with the loop antenna 72 at the corner section. The other end 74*b* of the element 74 is connected to a switch 75, which is connected to the pillar part 6 of the vehicle chassis 6. The element 74 is grounded to the vehicle chassis 4 to operate as the loop antenna for receiving the UHF band wave when the switch 75 is turned on, and made open to the vehicle chassis 4 to operate as the monopole antenna for receiving the VHF band wave when the switch 75 is turned off. Thus, the third embodiment also provides the similar advantages as the second embodiment.

The above embodiments and modifications may be implemented in many other ways. For instance, the loop antenna for receiving the UHF band radio wave may be in any loop shape other than the triangular loop shape. A plurality of antennas, each of which is constructed according to the second and third embodiments shown in FIGS. 9 to 11, may be arranged symmetrically as shown in FIGS. 7 and 8, so that space diversity may be realized. The plurality of antennas may be arranged asymmetrically to realize the space diversity. The antenna element need not be in a straight shape but may be in a curved shape or in a combination of the straight shape and the curved shape, so that the antenna may be arranged to avoid any obstacles on the windshield such as a vehicle inspection label.

What is claimed is:

1. An on-vehicle film antenna attached to a vehicle windshield, the antenna comprising:

a loop antenna having a first element set in length to correspond to a first radio wave of a first frequency band, one end of the first element being connected to a power supply near a border section between a vehicle chassis and the vehicle windshield and another end of the first element being connected to the vehicle chassis; and a monopole antenna having a second element set in length to correspond to a second radio wave of a second frequency band, one end of the second element being connected to the power supply near the border section in common with the one end of the first element and another end of the second element being disconnected from the vehicle chassis.

2. The on-vehicle film antenna according to claim 1, wherein the loop antenna and the monopole antenna are arranged near a corner section at which a ceiling part and a pillar part of the vehicle chassis join.

3. The on-vehicle film antenna according to claim 2, wherein the second element extends away from the corner section toward so that the another end of the second element is distanced from the power supply.

4. The on-vehicle film antenna according to claim 1, wherein the second element is shaped to have a part closely located to the first element.

* * * * *

UNITED STATES PATENT AND TRADEMARK OFFICE

CERTIFICATE OF CORRECTION

PATENT NO. : 7,633,453 B2
APPLICATION NO. : 11/475536
DATED : December 15, 2009
INVENTOR(S) : Kono et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 731 days.

Signed and Sealed this

Ninth Day of November, 2010

David J. Kappos

David J. Kappos
*Director of the United States Patent and Trademark Office*